US006761788B2

(12) United States Patent
DeYoung et al.

(10) Patent No.: US 6,761,788 B2
(45) Date of Patent: Jul. 13, 2004

(54) THERMAL MASS TRANSFER IMAGING SYSTEM

(75) Inventors: Anemarie DeYoung, Lexington, MA (US); James A. Foley, Wellesley, MA (US); Alfredo G. Kniazzeh, Waltham, MA (US); Edward P. Lindholm, Brookline, MA (US); Stephen J. Telfer, Arlington, MA (US); William T. Vetterling, Lexington, MA (US); Michael S. Viola, Burlington, MA (US); Hyung-Chul Choi, Lexington, MA (US)

(73) Assignee: Polaroid Corporation, Waltham, MA (US)

( * ) Notice: Subject to any disclaimer, the term of this patent is extended or adjusted under 35 U.S.C. 154(b) by 71 days.

(21) Appl. No.: 10/159,871

(22) Filed: May 30, 2002

(65) Prior Publication Data

US 2003/0113518 A1 Jun. 19, 2003

Related U.S. Application Data

(60) Provisional application No. 60/294,528, filed on May 30, 2001.

(51) Int. Cl.[7] ..... B41M 5/30

(52) U.S. Cl. ..... 156/235; 428/32.39; 428/32.5

(58) Field of Search ..... 156/235; 428/32.39, 428/32.5; 503/227

(56) References Cited

U.S. PATENT DOCUMENTS

| | | | | |
|---|---|---|---|---|
| 4,686,549 A | | 8/1987 | Williams et al. | 503/227 |
| 5,244,861 A | | 9/1993 | Campbell et al. | 503/227 |
| 5,521,626 A | | 5/1996 | Tanaka et al. | 347/183 |
| 5,563,347 A | | 10/1996 | Martin et al. | 73/756 |
| 5,612,281 A | | 3/1997 | Kobayashi et al. | 503/227 |
| 5,897,254 A | | 4/1999 | Tanaka et al. | 400/120.07 |
| 6,165,606 A | | 12/2000 | Kasahara et al. | 428/323 |
| 6,365,546 B1 | * | 4/2002 | Kometani | 503/227 |
| 6,380,132 B1 | * | 4/2002 | Mihara et al. | 503/227 |

FOREIGN PATENT DOCUMENTS

| | | | |
|---|---|---|---|
| EP | 0 630 759 A1 | 6/1994 | B41M/5/40 |
| EP | 0 965 461 A3 | 6/1999 | B41M/5/00 |
| EP | 0 965 461 A2 | 6/1999 | B41M/5/00 |

* cited by examiner

*Primary Examiner*—B. Hamilton Hess

(57) ABSTRACT

There is described a nanoporous receiver element for use in thermal mass transfer imaging applications. The receiver element comprises a substrate carrying an image-receiving layer comprising particulate material and a binder material. The substrate may comprise a material having a compressibility of at least 1% under a pressure of 1 Newton per $mm^2$ (1 MPa). Optionally, there may be provided, between the substrate and the nanoporous receiving layer, a layer having a thickness of less than about 50 $\mu$m which is comprised entirely of a material having a compressibility of less than about 1% under a pressure of 1 MPa. Alternatively, the substrate may comprise only the material having a compressibility of less than about 1% under a pressure of 1 MPa, provided that the thickness of the substrate does not exceed about 50 $\mu$m. The image-receiving layer comprises particulate material and a binder material, has a void volume of from about 40% to about 70% and a pore diameter distribution wherein at least 50% of the pores having a diameter greater than about 30 nm have diameters less than about 300 nm and at least 95% of the pores having diameters greater than about 300 nm have diameters less than about 1000 nm.

25 Claims, 3 Drawing Sheets

THERMAL MASS TRANSFER IMAGING SYSTEM

REFERENCE TO RELATED APPLICATIONS

This application claims the benefit of prior provisional patent application Serial No. 60/294,528, filed May 30, 2001.

Reference is made to prior, commonly assigned patent application Ser. No. 09/745,700, filed Dec. 21, 2000, now U.S. Pat. No. 6,537,410 B2, which is incorporated by reference herein.

FIELD OF THE INVENTION

This invention relates to a receiver element for use in thermal mass transfer imaging applications and, more particularly, to such a receiver element which includes a nanoporous, ultrasmooth image-receiving layer. The invention also relates to a thermal transfer imaging system including the receiver element.

BACKGROUND OF THE INVENTION

A number of different printing systems make use of thermally induced transfer of a colorant, such as a dye, from a donor element to a receiver element. In some of these systems the dye alone diffuses from a polymeric binder on the donor element to another polymeric layer on the receiver element, whereas in others, a vehicle (which may be a polymeric binder, a wax, or a combination of the two) and the dye are transferred together from the donor element to the receiver element. The latter process is commonly referred to as thermal mass transfer.

There are known in the art a number of different types of donor elements for use in thermal mass transfer imaging. For example, waxes or resins are commonly reported as vehicles or binders, while dyes or pigments may be used as colorants.

There are also known in the art various types of receiving elements for use in thermal mass transfer imaging. Certain of these receiving elements contain materials which soften at imaging temperatures in order to absorb transferred materials. Such a receiver element, for example, is described in U.S. Pat. No. 4,686,549. However, an alternative, and often preferable, receiver element uses receiving materials which are surface porous, so that the heated donor material adheres preferentially to the receiver by fully or partially flowing into the pores of the receiver element. For example, U.S. Pat. Nos. 5,521,626 and 5,897,254 describe the transfer of material from a heated donor element to a surface-porous receiver sheet in which the pore diameter is in the range of 1–10 micrometers. U.S. Pat. No. 5,563,347 describes a similar system. Unfortunately, in these prior art examples, the size of the pores in the receiver sheet is sufficient to scatter visible light, and as a result the receiver element has a matte appearance.

Surface porous receiver coatings have been devised for ink jet printing in which the average pore diameter is considerably less than one micrometer (usually in the range of about 0.02–0.2 $\mu$m). Such surface porous layers are herein referred to as nanoporous. Pores of this small size do not appreciably scatter visible light, and therefore the receiver sheet can have a glossy appearance. For example, receiver sheet compositions described in U.S. Pat. Nos. 5,612,281 and 6,165,606, directed for use in inkjet printing, have the characteristics of being nanoporous and glossy. The viscosity of a typical ink is considerably lower than that of the conventional thermal mass transfer materials described above (at their transfer temperature), and consequently ink can penetrate the smaller pores of the nanoporous receiver coatings whereas the molten conventional mass transfer donor materials cannot.

There are, however, properties required of a receiver element for thermal mass transfer which these prior art ink-jet receiver elements do not possess. Some of these additional required properties result from the method by which a thermal mass transfer process is used to produce images approaching photographic quality. The resolution of an image produced by a thermal transfer process employing a page-wide array of heating elements (commonly referred to as a "thermal print head") is limited by the resolution of the thermal print head employed. In a typical printing arrangement, the donor and receiver elements are brought together, and the resulting laminar assembly is translated beneath the thermal print head. Electrical current is supplied only to those heating elements corresponding to pixels which are to be colored in the line of the image being printed at a particular time. Thus, a thermal print head having, say, three hundred heating elements per inch can transfer only three hundred dots per inch from the donor element to the receiver element in the direction transverse to the motion of the two elements relative to the print head. (Obviously, more than three hundred dots per inch may be printed in the direction of motion). If the transferred dots are all equal in size, each pixel in the final image will only have two possible levels of gray: either full dye density (Dmax) or no dye density (Dmin). At a (typical) resolution of three hundred dots per inch, this number of gray levels is insufficient to produce an image of photographic quality. In some prior art thermal mass transfer imaging processes, as described for example in "A New Thermal Transfer Ink Sheet for Continuous-Tone Full Color Printer", by M. Kutami, M. Shimura, S. Suzuki and K. Yamagishi, J. Imaging Sci., 1990, 16, 70–74, the attempt is made to attain the numerous shades of gray necessary to produce an image of photographic appearance by changing the size of a dot (of constant dye density) within the limitation on pixel spacing imposed by the resolution of the thermal print head.

One confounding factor in producing images of high quality by means of dot size variation is the problem of graininess. Graininess is caused by lack of precise control in the size of dots printed. Whereas a field of identical small dots will appear to the eye to have a smooth appearance (provided that the individual dots cannot be resolved), a field of dots of the same average size, but with a broader distribution of sizes around the average, may acquire a grainy, or mottled, appearance.

If the receiving element in a thermal mass transfer imaging process is not sufficiently flat and smooth, the contact between the donor element and the receiving element may be uneven. Such uneven contact may lead to the formation of dots of uncontrolled size (since transfer will be more efficient onto "hills" than into "valleys"), and this will be manifested as a grainy appearance to the image. The prior art ink jet receiving elements described above typically do not have the flatness and smoothness required to avoid unacceptable graininess when used in a thermal mass transfer process in conjunction with a thermal print head.

Other desirable properties for thermal transfer receiver elements have also been described in the prior art. In order to ensure an even contact between the donor and receiver elements across the whole width of a thermal head during printing, some compressibility of the receiver element is preferred. In addition, in order that the heat provided by the thermal print head be used as efficiently as possible, the receiver element preferably has a low thermal conductivity. Thus, for example, U.S. Pat. No. 5,244,861 describes a receiving element comprising a substrate having a dye image-receiving layer. The substrate is a composite film made up of a microvoided thermoplastic core layer and at least one substantially void-free thermoplastic surface layer. The microvoided thermoplastic core provides the necessary compressibility and low thermal conductivity for the receiver element. The thermal conductivity of the receiving element should also be spatially uniform in directions parallel to the image plane. Non-uniformities in thermal conductivity will be manifest as dye density variations in an image produced by a thermal transfer technique. This is because the temperatures to which the donor and receiver elements are heated by a given heating pulse from the thermal print head depends upon the rate of loss of heat by conduction through the receiver substrate, and the dye density achieved is a function of these temperatures.

As the state of the thermal imaging art advances efforts continue to be made to provide new thermal imaging systems that can meet new performance requirements, and to reduce or eliminate some of the undesirable characteristics of the known systems. It would be advantageous to have a receiver element for use in thermal mass transfer imaging applications that can provide images having a glossy appearance.

SUMMARY OF THE INVENTION

It is therefore an object of this invention to provide a novel receiving element for use in thermal mass transfer imaging applications.

It is another object of the invention to provide a receiver element that has a nanoporous, ultrasmooth receiver layer.

It is still another object of the invention to provide a receiver element having a glossy appearance.

Yet another object of the invention is to provide a receiver element which can minimize visible image defects caused by small particles entrapped between the donor and receiver elements during formation of the image;

It is a further object of the invention to provide a receiver element that can provide stabilization for images deposited on the receiving element, both with respect to lateral diffusion of transferred colorants and to photofading of transferred colorants.

Still further, it is an object of the invention to provide a thermal mass transfer imaging system.

These and other objects and advantages are accomplished in accordance with the invention by providing a receiving element for use in mass transfer thermal imaging applications which comprises a substrate carrying on a surface thereof, a nanoporous, ultrasmooth receiver layer. The substrate may comprise a material having a compressibility of at least 1% under a pressure of 1 Newton per square millimeter (1 MPa). Optionally, there may be provided, between the substrate and the nanoporous receiving layer, a layer having a thickness of less than about 50 $\mu$m which is comprised entirely of a material having a compressibility of less than about 1% under a pressure 1 MPa. Alternatively, the substrate may comprise only the material having a compressibility of less than about 1% under a pressure of 1 MPa, provided that the thickness of the substrate does not exceed about 50 $\mu$m.

The image-receiving layer has a uniformly voided structure having a porous surface. The void volume of the image-receiving layer is between about 40% and about 70%. The pore diameter distribution, sampled at regularly spaced intervals, is such that at least about 50% of pores having diameters larger than about 30 nm have diameters smaller than about 300 nm, and at least about 95% of pores having diameters larger than about 30 nm have diameters smaller than about 1000 nm. In a particularly preferred embodiment, at least about 50% of pores having diameters larger than about 30 nm have diameters smaller than about 200 nm, and at least about 95% of pores having diameters larger than about 30 nm have diameters smaller than about about 500 nm.

It is preferred that the root mean square (RMS) surface roughness of the image-receiving layer, as measured over an area of about 1.5 mm by about 1.5 mm, be less than about 300 nm. A particularly preferred RMS surface roughness is less than about 200 nm.

The image-receiving layer comprises a particulate material that may be organic or inorganic and a binder. In a preferred embodiment the binder is a hydrophobic polymeric material. In another preferred embodiment the receiver element further comprises a wash coating which is deposited on the image-receiving layer in such a manner that additional addenda such as photostabilizers are introduced into the nanoporous receiving layer.

There is also provided a thermal mass transfer imaging system which comprises the advantageous receiver element and a donor element having a solid thermal transfer material which is converted to a low viscosity fluid at the thermal imaging temperature.

BRIEF DESCRIPTION OF THE DRAWINGS

For a better understanding of the invention as well as other objects and further features thereof, reference is made to the following detailed description of various preferred embodiments thereof taken in conjunction with the accompanying drawings wherein.

DESCRIPTION OF THE PREFERRED EMBODIMENTS

Figure 1:
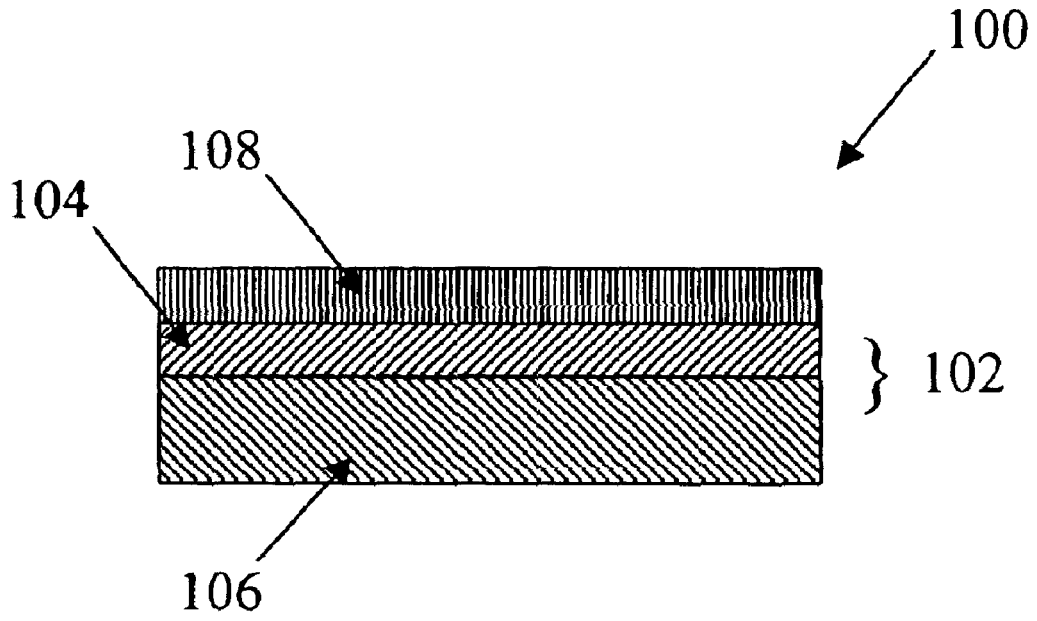
FIG. 1 is a partially schematic, side sectional view of a receiver element according to the invention.

Referring now to FIG. 1 there is seen a receiver element 100 which includes a substrate 102 which may be a single layer 104, a single layer 106, or a composite structure made up of layer 104 and layer 106. Substrate 102 has properties which can assist in minimizing visible defects in the final image caused by small particles entrapped between the donor and receiver elements during formation of the image. A difficulty which may be encountered when thermal transfer methods are used to make images intended to have photographic quality is that small particles of dirt or dust may become entrapped between the donor element and the receiver element during printing. The presence of such particles may impede the transfer of a colorant such as a dye from donor to receiver, thereby causing the formation of a visible defect in the final image. The size of this defect may be strongly affected by the physical properties of the donor and receiver elements themselves.

Figure 2:
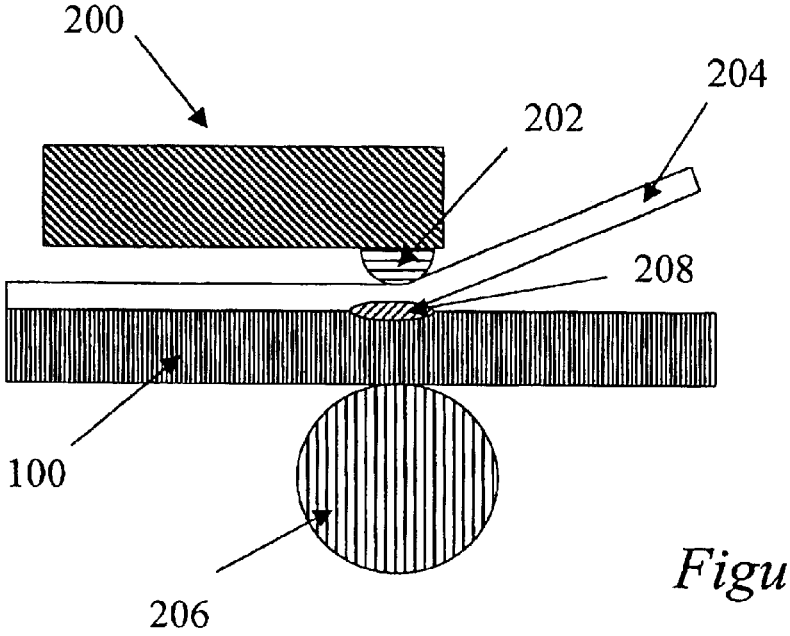
FIG. 2 is a partially schematic, side sectional view of a thermal mass transfer imaging system according to the invention.

Referring now to FIG. 2, there is shown a thermal print head 200 bearing a raised nib 202 (on which the thermal printing elements are disposed) in contact with a donor element 204. Donor element 204 is pressed against the receiver element 100 of the present invention, behind which is platen roller 206. Also shown is a dust particle 208. If neither the donor element 204 nor the receiver element 100 is sufficiently compressible, a "tent" may form around the particle 208, preventing intimate contact between the donor and the receiver, and causing the formation of a defect in the image that may be many times larger than the particle itself.

In certain instances such as, for example, where the donor element comprises a very thin substrate carrying an even thinner imaging layer, as will be described in detail below herein, it may not be desirable to make the donor element sufficiently compressive to avoid such "tenting". Therefore, according to the invention compressibility is preferably built either into the receiver element, or, where the receiver element is sufficiently thin, into the platen roller 206. Experimentally, it has been determined that acceptable performance for typical dust and dirt particles (whose largest dimension typically does not exceed about 15 μm) may be obtained when the image-receiving layer is carried by a substrate of which not more than about the upper 50 μm consists of a material whose compressibility is less than about 1% under a pressure of 1 MPa. Thus, referring to FIG. 1, the substrate 102 for the receiver element 100 may be a single layer 104 of from about 10 to about 50 μm in thickness, uniformly composed of material whose compressibility is less than about 1% under a pressure of 1 MPa. Layer 104 may be, for example, a polymeric material such as poly(ethylene terephthalate) whose compressibility has been measured to be about 0.03%/MPa. The image-receiving layer itself typically has a compressibility of about 0.02%/MPa. The compliance necessary to accommodate dust particles may then be supplied by the platen roller 206. Alternatively, the substrate 102 may be a laminate structure, the upper 50 μm or less of which comprise a layer 104 of a material having a compressibility of less than about 1%/MPa with the remainder of the structure comprising a layer 106 of a material or materials having a compressibility of at least 1%/Mpa. A suitable material for layer 106, for example, is a microvoided polypropylene, whose compressibility is about 4% under the indicated conditions. As described above, substrate 102 may comprise layer 106 alone.

The compressibility of the receiver element is thought to have three functions in regard to dirt sensitivity. Referring again to FIG. 2, compressibility of the receiver element 100 firstly permits the image-receiving layer to deform around the nib 202 of the thermal print head 200 over a width comparable to the width of the thermal element and with an indentation depth of several microns. This deformation depends on the bending stiffness of the image-receiving layer, the compressibility of the receiver element substrate, the nib radius and the force on the thermal head.

Secondly, compressibility reduces the force needed to push the dirt particle into the receiver. As a result the local incremental compression of platen roller 206 is minimized. If the compression of the platen roller 206 becomes larger than the indentation of the receiver element, a large print defect will occur, possibly having size of the order of millimeters. The compression of the platen roller 206 can be minimized by hardening or enlarging the roller, but other considerations typically limit the applicability of this approach.

Thirdly, the characteristic width of the indentation of the image-receiving layer is thought to depend upon the inverse cube root of its compression modulus. The approximate size of the defects, B, observed for spherical dirt particles of diameter D appears to increase rapidly from B=200 μm for D=25 μm, reaching B=500 μm at D=40 μm. This threshold behavior may relate to the interaction of the perimeter of the dirt indentation with the background indentation. Taking the three effects described above into consideration, the optimum compressibility of receiver element 100 appears to be in the range of 2 to 60%/MPa.

The substrate material preferably has good thermal insulation properties in order to allow improved sensitivity for the thermal imaging system used to form the image, by preventing the conduction of heat beyond the active area of imaging. Typically substrate 102 has a thickness in the range of from about 10 μm to about 300 μm. Substrate 102 may be opaque or transparent. In a preferred embodiment substrate 102 comprises an opaque thermoplastic polymeric material. A preferred substrate material according to the invention is an approximately 12 μm thick layer of a clear poly(ethylene terephthalate) film laminated onto an approximately 150 μm thick layer of microvoided polypropylene.

In a preferred embodiment where the receiver element is utilized to provide images of very high quality and low granularity, it is desirable to coat the image-receiving layer onto a very smooth surface. The smoothness of the image-receiving layer typically closely matches that of the substrate onto which it is coated. In a preferred embodiment of the invention the smoothness of the substrate onto which the image-receiving layer is deposited is such as to give an RMS roughness of the image-receiving layer of on the order of less than about 300 nm over an area of about 1.5 mm by 1.5 mm, and particularly preferably less than about 200 nm as measured over this area. Accordingly, substrate materials having smoothness that can lead to this property are preferred. If the substrate comprises layer 106, but not layer 104, then layer 106 must have the required smoothness. Where the substrate comprises both layer 106 and layer 104, or layer 104 alone, then layer 104 preferably has the required smoothness.

The desired surface smoothness can be provided by a variety of techniques. In a preferred embodiment, layer 104 is a smooth sheet of a thermoplastic polymeric material such as a poly(ethylene terephthalate). As described above, layer 104 has a thickness in the range of from about 10 to about 50 μm. A typical suitable material for use in layer 104 is grade 453 polyester available from E. I. duPont de Nemours in 48 and 92 gauge thickness ("gauge" herein refers to one percent of one thousandth of an inch). The polyester material also provides a very high gloss for the receiving element.

Where the substrate 102 is a composite structure as previously described, the desired surface smoothness also can be provided by coating or laminating layer 104 onto layer 106 by various methods. Layer 104 can be formed by: depositing a polymeric or monomeric material either as a very concentrated solution, or without solvent, this material having viscosity sufficiently low as to allow leveling by surface tension effects, followed by curing of the polymeric or monomeric material by irradiation or heating; by coating a self-leveling polymer followed by drying the material; by depositing a polymer such as a polyethylene or polypropylene by an extrusion process; or by a "cast coat" process in which there is utilized a polymer which has a softening temperature below the temperature of a heated smoothing drum.

A preferred material for layer 104 comprises a polymer coated from water such as polyethylene acrylic acid, type 4983R, available from Michelman Company, coated at a thickness of from about 10 to about 20 μm and then smoothed by being contacted with a heated smoothing drum.

Image-receiving layer 108 comprises particulate material in a binder. Typically, layer 108 comprises from about 60 to about 90 percent by weight of particulate material and from about 10 to about 40 percent by weight of binder material. The image-receiving layer 108 has a uniformly voided structure having a porous surface. As previously described, the void volume of the layer is between about 40% and about 70%. The pore diameter distribution, sampled at regularly spaced intervals, is preferably such that at least about 50% of pores having diameters larger than 30 nm are smaller than about 300 nm, and at least about 95% of pores having diameters larger than 30 nm are smaller than about 1000 nm. In a particularly preferred embodiment, at least about 50% of pores having diameters larger than 30 nm are smaller than about 200 nm, and at least about 95% of pores having diameters larger than 30 nm are smaller than about 500 nm. As described previously, it is preferred that the root mean square (RMS) surface roughness of the image-receiving layer be less than about 300 nm, as measured over an area of about 1.5 mm by 1.5 mm. A particularly preferred RMS surface roughness measured over this area is less than about 200 nm.

The smoothness requirement in this preferred embodiment is for the minimization of image graininess. Graininess is the measure of image noise perceived by the human observer in an area of uniform print density. Granularity is an objective measure of the image noise and is computed from the Wiener spectrum of the spatial variation of optical density. First, the Wiener spectrum is measured by scanning a uniform print area with a long narrow slit (as described in J. C. Dainty, R. Shaw, Image Science, London 1974, pp. 276). Granularity is then calculated as a weighted average of the Wiener spectrum over the spatial frequency component, using the spatial frequency response of the human visual system as weighting function (C. J. Bartleson, Predicting Graininess from Granularity, J. Photogr. Sci., 33, 117 (1985)).

It has been found experimentally that the image granularity (measured using methods similar to those described above) increases approximately linearly with the receiver RMS surface roughness over an area of about 1.5 mm by 1.5 mm (measured using an optical interferometer WYKO RST, available from Veeco Instruments, Tucson, Ariz. 85706). For further discussion, see Example VII hereinbelow.

The particulate material used in image-receiving layer 108 can be any suitable material. Typical suitable particulate materials include calcium carbonate, alumina, titanium dioxide, plastic particles, hollow sphere particles such as the Ropaques, available from Rohm and Haas, silica gel, amorphous silica and fumed silica particles. In a preferred embodiment, layer 108 is formed from a water dispersion of fumed silica. Fumed silica has been found to provide a high degree of gloss, a high void volume, and pore sizes suitable for transfer of melted donor material.

The binder may be any suitable material that is compatible with the particulate material. Typical suitable binder materials include, for example, thermoplastic polymeric materials such as poly(vinyl alcohol) and poly(vinyl pyrrolidone), cellulosic materials, gelatin, latex materials and the like. A preferred material is Airvol 540, available from Air Products and Chemicals, Inc., Allentown, Pa., which is a poly(vinyl alcohol) having an 87% degree of hydrolysis.

The binder used in image-receiving layer 108 may, however, influence the stability of the final image formed by thermal transfer of colorants. One of the major problems commonly encountered in the use of nanoporous receiving layers for dyes is the heat-induced migration of dye molecules away from the originally printed dots, particularly in environments of high humidity. Such migration of dyes leads to an increase in the amount of light absorbed by the layer, and as a result, in darkening of the image. If all the dyes of a multicolor image do not migrate at the same rate, color shifts may be observed. In high humidity environments, hydrophilic binders such as poly(vinyl alcohol) can absorb water and provide a medium in which the dyes partially dissolve and diffuse.

It has been found that this phenomenon can be alleviated by substantially replacing the hydrophilic binder polymer with a hydrophobic material. Accordingly, in a preferred embodiment all, or a very high percentage, of the binder material is hydrophobic. Typical suitable hydrophobic binder materials include acrylic polymeric materials such as Carboset 526, (available from BFGoodrich Company, Specialty Polymers and Chemicals Division, Cleveland, Ohio), Joncryl resins (available from S. C. Johnson Company, Racine, Wis.) and Neocryl resins (available from Avecia Corporation, Wilmington, Mass.).

A preferred type of hydrophobic binder is an acid-containing polymeric material. A salt formed between such a material and either an amine or ammonia will readily dissolve in an aqueous coating fluid. After deposition onto the receiver substrate, heating the coating causes the evolution of ammonia or an amine with an accompanying change of the polymeric binder to a hydrophobic, water-insoluble material. A particularly preferred hydrophobic binder material is a carboxylated acrylic polymer, Carboset 526. A relatively small amount, e.g., up to about 20% by weight of the total binder material, of polyvinyl alcohol or other hydrophilic polymer is preferred to remain in the formulation to provide improved film properties.

Carboset 526 is a solid acrylic resin with the following properties: acid number=100, molecular weight=200,000, glass transition temperature=70° C. To assist those skilled in the art to better understand and practice the invention, the importance of each of these properties is discussed below.

The acid number, which results from (meth)acrylate carboxylic acids copolymerized at the optimum level with uniform chain distribution, confers both good coating fluid interactions and dry layer properties. A salt formed between either an amine or ammonia and lower acid number acrylic acid polymers may not be fully soluble in water, and may not be as effective at preventing cracks during drying. Higher acid number acrylic acid polymers may be more hydrophilic after removal of ammonia and thus may not be as effective in preventing dye diffusion in conditions of high humidity.

The molecular weight affects the ability of the polymer to function as an effective binder for the particulate material during drying of the layer. The major benefit of an optimum molecular weight is thought to be the ability to dry the formulation at a high particulate material to binder ratio (4/1 or 3/1 particulate material/binder) without the formation of cracks. High particulate material/binder ratios are desired to to provide the desired porosity of the receiver layer. It has been found that acrylic polymers with relatively low molecular weights require higher binder ratios, e.g., 2/1 or even 1/1, to yield dry coatings without cracks.

The presence of relatively soft binder materials tends to lead to sticking of the donor element to the receiver layer, and even to fracture of the receiver element itself by sticking to the donor element during imaging. This effect is known as "pull-out", and commonly occurs in the center of a dot, where the temperature is highest.

Image-receiving layer 108 may include other addenda such as humectants (e.g., glycerol, urea and silanes) to assist in the prevention of cracking of the layer during coating and drying, surface active agents for modifying the surface energy of the coating as well as improving the coatability of the dispersion, and cross-linking agents such as boric acid, glyoxal, diepoxides and silylated epoxides.

In a particularly preferred embodiment, the image-receiving layer includes epoxysilanes. It is thought that these materials allow the image-receiving layer to better withstand the high temperatures needed to fully image a hydrophobic receiver to Dmax. Functional silanes are well known in the art as coupling agents which form covalent bonds between inorganic surfaces and organic materials. Epoxysilanes Silquest A-186, (beta-(3,4-epoxycyclohexyl) ethyltrimethoxysilane) and Silquest A-187, (gamma-glycidoxypropyltrimethoxysilane) available from OSi Specialties, Crompton Corporation, Greenwich, Conn., were found to provide, in conjunction with Carboset 526 as the binder, a hydrophobic image-receiving layer which was more resistant to the "pull-out" effect described above.

An additional benefit of the presence of the silanes in the hydrophobic image-receiving layer was found to be an increase in gloss of the dried layer. The reasons for this increase in gloss are not well understood, but the "hydrophobicity" of the organic moiety that is assumed to be partially covering the surface of the silica may have a bearing on the packing behavior of the fumed silica particles during the drying process. The highest gloss is attained in the following order: Silquest A-174 (gamma-methacrylamidopropyltrimethoxysilane)>Silquest A-186>no silane >Silquest A-187. This "hydrophobic silane effect" was also observed in the use of unsubstituted alkyltrimethoxysilanes such as propyltrimethoxysilane and isobutyltrimethoxysilane. It is also possible to combine silanes to optimize gloss and "coupling/crosslinking"; a preferred formulation utilizes 3% (wt silane/wt dry silica) Silquest A-174 together with 5% Silquest A-187 to give high gloss with good physical layer strengthening.

Image-receiving layer 108 is typically coated at a dry coverage of from about 3 to about 15 grams per square meter. A preferred coverage is about 6.5 $g/m^2$.

Receiver element 10 of the invention may also contain an optional washcoat layer (not shown) which may include photostabilizer materials and the like. The active materials include antioxidants or hindered amine stabilizers such as Tinuvins, available from Ciba Specialty Chemicals Corporation, Tarrytown, N.Y., transition metal salts, such as cobalt(II) or copper(II) salts, or aluminum compounds, such as aluminum chlorohydrate. The latter have been found to assist in promoting ozone resistance of the image, particularly in the case of ozone-sensitive copper phthalocyanine dyes, possibly by blocking small channels in the image-receiving element through which ozone could otherwise diffuse. The washcoat layer may be coated from either aqueous solution or from solutions of solvents such as 2-propanol and the like. Because the image-receiving layer 108 has a porous surface, the coating solution can penetrate the pores of image-receiving layer 108 and, after drying, the active materials can be incorporated within the porous structure of image-receiving layer 108.

The image-receiving elements of the invention may be manufactured by various methods. In addition to the direct deposition of the image-receiving layer onto the substrate, in another preferred method the image-receiving layer formulation is coated on a smooth temporary substrate to which it will not adhere, e.g., a polystyrene or a polyester film, and dried. The image-receiving layer is then transferred to the substrate layer for the receiver element, which may have an adhesive surface to assist the image-receiving layer to adhere to the substrate.

According to the thermal mass transfer imaging system of the invention, the image-receiving element is used in conjunction with a donor element which is described and claimed in copending, commonly assigned, U.S. patent application Ser. No. 09/745,700, filed Dec. 21, 2000, now U.S. Pat. No. 6,537,410 B2, which is incorporated by reference herein in its entirety. The advantageous donor element comprises a substrate bearing a layer of thermal transfer material comprising a dye-containing, amorphous (non-crystalline) phase that includes at least one dye and wherein the dye or dyes present in the amorphous phase form a continuous film. Optionally, and preferably, the thermal transfer material layer includes at least one thermal solvent such that at least part of the thermal solvent material is incorporated into the dye-containing phase and another part of the thermal solvent forms a second, crystalline, phase separate from the dye-containing phase. The crystalline thermal solvent in the thermal transfer material layer melts and dissolves or liquefies the dye-containing phase thereby permitting dissolution or liquefaction to occur at a temperature lower than that at which such dissolution or liquefaction to occur in the absence of the crystalline thermal solvent. The thermal transfer material layer is characterized in that it is a solid transparent or translucent film which does not undergo any detectable flow at room temperature and the film is formed by the dye(s) in the amorphous phase.

The dyes which are used in the thermal transfer material layer can be those which form solids which are themselves amorphous, that is to say, solids which lack the long-range ordered structure characteristic of crystalline solids. Amorphous solids formed from low molecular weight organic compounds have been described in the art. Such films can be stabilized with respect to the corresponding crystalline phase either thermodynamically (for example, by using in the glass phase a mixture of two or more chemically similar molecules) or kinetically, by means of a network of weak bonds (for example, hydrogen bonds) between the individual molecules.

Any type of weak non-covalent intermolecular bonding can be used for stabilization of amorphous solid dye films, for example, coulombic interactions between ionic compounds, hydrogen bonds and Van der Waals interactions. In a preferred embodiments of the donor element, the dye-containing phase may comprise a dye capable of forming hydrogen bonds with its neighbors. Numerous examples of such compounds are known; for example, the hydrogen bond-forming dye may be an azo or anthraquinone dye bearing at least one di-hydroxybenzene ring (the term "dihydroxybenzene ring" being used herein to include tri-, tetra, and penta-hydroxy substituted rings). Certain ionic dyes, several of which are available commercially, have sufficient solubility in coating solvents, e.g., n-butanol, to be cast as thin films of amorphous solid dyes with sufficient cohesive and adhesive strength that they are not removed from a donor sheet substrate by adhesive tape. These films also have glass transition temperatures substantially above room temperature such that they are not tacky at room temperature. It is not necessary for the ionic dyes to have two separate ions; such dyes can be zwitterions. Examples of other suitable dyes include Solvent Yellow 13, Solvent Yellow 19, Solvent Yellow 36, Solvent Yellow 47, Solvent Yellow 88, Solvent Yellow 143, Basic Yellow 27, Solvent Red 35, Solvent Red 49, Solvent Red 52, Solvent Red 91, Solvent Red 122, Solvent Red 125, Solvent Red 127, Basic Red 1, Basic Violet 10, Solvent Blue 5, Solvent Blue 25. Solvent Blue 35, Solvent Blue 38, Solvent Blue 44, Solvent Blue 45, Solvent Blue 67, Solvent Blue 70, Basic Blue 1, Basic Blue 2, and Basic Blue 33. These dyes are well known and are described in the literature, for example, in the Color Index. Other examples of such dyes are Kayaset Yellow K-CL, Kayaset Blue K-FL and Kayaset Black K-R, all available from Nippon Kayaku Company, Ltd., Color Chemicals Div., Tokyo, Japan. Mixtures of these dyes can also be used to form amorphous solid films for use in the thermal transfer material layers of the donor elements.

There are several different preferred embodiments of the thermal transfer material which may be broadly divided into two types, namely single phase embodiments and multi-phase embodiments. As the name implies, in the single phase embodiments the transfer layer material contains primarily only a single dye-containing phase, although there may be present small amounts of an additive or additives in separate phases. Such additives may be, for example, light stabilizers, ultra-violet absorbers and antioxidants. Thus, this dye-containing phase may contain essentially a dye or mixture of dyes with little if any other material. Generally, any other ingredients in the thermal transfer material layer would not necessarily be film-forming materials since the principal film-forming component of the layer is the dye itself.

The dye-containing phase can be a single compound (such as those listed above) capable of itself forming the necessary amorphous, non-crystalline phase, or a mixture of such compounds. This embodiment has the advantage that it is capable of providing very thin transfer material layers, since there is no, or a minimal amount of, "diluent" present with the dye. The single phase transfer material layer embodiments of the invention are particularly well-suited for certain applications such as variable dot thermal transfer. The glass transition temperatures of certain dyes, especially the ionic dyes, may be relatively high (in some cases substantially in excess of 100° C.), so that substantial energy input per unit area imaged can be required in order to convert the transfer material from its solid condition to a flowable state whereby the material can be transferred imagewise to a receiver sheet. High energy input is not desirable in a portable printer or other imaging apparatus where energy usage can be a major concern, and high energy input per unit area can limit printing speed in a thermal head. Thus, the single phase transfer layers may be preferred for use in thermal transfer applications where energy requirements are not a major concern.

Alternatively, the transfer material layer in a single phase embodiment may comprise a dye non-covalently bonded (typically hydrogen bonded) to a second, non-dye component. For example, one of the dye and the second component may comprise a plurality of acid groups and the other may comprise a plurality of basic groups. Various dyes (which, as pure compounds, may or may not form amorphous dye solid films) form amorphous, non-crystalline networks with other non-dye components, and that these networks can be used to provide the dye-containing phase of the thermal transfer material layer. The amorphous (non-crystalline) nature of these networks can be confirmed by absence of X-ray diffraction peaks. The use of such networks permits the use of dyes which do not, by themselves, form amorphous dye solid films, thereby widening the choice of dyes available.

While there is no intention to exclude the possibility of other techniques which may be used to form the aforementioned networks, in the preferred form of this embodiment one of the dye and the second, non-dye component comprises a plurality of acid groups and the other comprises a plurality of basic groups, preferably nitrogenous basic groups, and most desirably nitrogenous heterocyclic basic groups. For example, the dye may comprise a plurality of carboxylic acid groups and the second, non-dye component may be 1,3-di(4-pyridyl)propane. These two materials form a single phase which appears to be an amorphous hydrogen-bonded network having a glass transition temperature very close to the melting point (46° C.) of the non-dye component.

In the two phase embodiment, the transfer layer comprises a mixture of the dye-containing phase and at least one "thermal solvent", which is a crystalline material. At least a portion of the thermal solvent present in the thermal transfer material layer forms a phase separate from the dye-containing phase. The thermal solvent is believed to be equilibrated between the amorphous form present in the dye-containing amorphous phase and the crystalline form present in the other phase. The amount of thermal solvent which can be present in the dye-containing amorphous phase is thought to be limited by the Tg of the amorphous phase which is preferably at least about 50° C. and particularly preferably about 60° C. In this manner blocking, i.e., sticking together, of the thermal transfer donor sheets can be avoided even under high temperature storage conditions. Preferably, there should be no first order phase change for the entire thermal transfer material layer, i.e., there should be no melting of the layer, below about 50° C. The crystalline thermal solvent melts during the heating of the donor sheet and dissolves or liquefies the dye-containing phase, thereby permitting the transfer of portions of the transfer layer to the receiving sheet to occur at a temperature lower than such transfer would occur in the absence of the crystalline thermal solvent. The mixture of dye(s) and thermal solvent melts at a temperature which is approximately the same as that of the crystalline thermal solvent itself (and substantially below the melting point of the dye in the powder (crystalline) form).

In some preferred embodiments, the thermal solvent selected for the transfer layer is a good solvent for the dye(s) of the dye-containing phase. In these embodiments, the dot size of the transferred imaging material may be varied by use of a thermal printing head optimized for variable dot printing.

The two phase embodiment allows dye transfer to be effected at temperatures substantially lower than those achievable when the transfer layer contains only the same dye-containing phase, and hence with lower energy inputs per unit area imaged. The thermal solvent used can be any fusible material which melts above ambient temperature and which dissolves or liquefies the dye-containing phase to form a mixture which transfers at a lower temperature than that of the dye-containing phase alone. The ratio of thermal solvent to dye may range from about 1:3 by weight to about 3:1. A preferred ratio is about 2:1. Thus, the two phase embodiment can provide a major reduction of imaging temperature while maintaining a thin donor layer. The thermal solvent may separate into a second phase as the mixture cools after imaging, and preferably the thermal solvent should not form such large crystals that it adversely affects the quality of the resulting image. The thermal solvent preferably has a melting point sufficiently above room temperature such that the donor layer is not tacky at room temperature, and does not melt at temperatures likely to be encountered during transportation and storage of the donor sheet prior to imaging.

The crystalline thermal solvents used in the two-phase embodiments typically have a melting point in the range of from about 60° C. to about 120° C. and preferably in the range of from about 85° C. to about 100° C. It is particularly preferred that the thermal solvent have a melting point of about 90° C.

Not all the thermal solvent component of the donor layer, prior to imaging, will crystallize out from the dye-containing phase and form a second phase separate from the dye-containing phase. The amount of thermal solvent in the transfer material layer which is incorporated in the dye-containing phase can be controlled by including additives in the dye-containing phase to make the latter more compatible with the thermal solvent thereby resulting in a higher percentage of the thermal solvent being located in the dye-containing phase. Such additives could be, for example, molecules similar to the thermal solvent which do not crystallize under the conditions of preparation of the donor layer or other additives such as light stabilizers. It is preferred to utilize thermal solvents which form relatively small crystals since these dissolve the dye-containing phase quickly during imaging to provide satisfactory transfer of the dye to the receiver layer.

The relative amounts of thermal solvent which are in the dye containing and second, crystalline phases of the transfer layer can be determined by measuring the heat of fusion of the transfer layer material and comparing the value with the heat of fusion of the same mass of thermal solvent present in the transfer layer. The ratio of the respective values will indicate the proportions of thermal solvent present in the dye-containing phase and the second, crystalline phase.

In the two phase embodiments of the invention a phase change occurs between room temperature and the imaging temperature such that essentially one phase is formed. The dye-containing phase transfer layer, which is not tacky at room temperature, undergoes a composition change such that it has relatively low viscosity at the imaging temperature to allow the imaging material to be transferred to the receiving layer.

In another preferred embodiment more than one thermal solvent is incorporated into the transfer layer. If a transfer layer is used which comprises two (or more) different thermal solvents having differing melting points and chosen so that the thermal solvent having the lower melting point dissolves or liquefies less of the dye-containing phase than the thermal solvent having the higher melting point, the amount of dye-containing phase transferred per imaged pixel during the imaging method varies according to the temperature to which the transfer layer is heated. It has been found possible, with certain imaging systems, to obtain good continuous-tone performance using only two thermal solvents in addition to the dye-containing phase. Such continuous-tone performance is an important advantage of the present invention as compared with conventional thermal mass transfer processes, in which the mass transfer is strictly binary. Alternatively, the use of two or more dyes which have differing solubilities in a single thermal solvent may be employed.

Obviously, the thermal solvent used in any specific imaging system of the present invention must be chosen having regard to the dye-containing phase and other components of the proposed system. The thermal solvent should also be sufficiently non-volatile that it does not substantially sublime from the thin transfer layer during transportation and storage of the donor sheet prior to imaging. Any suitable thermal solvent may be used in accordance with the invention. Suitable thermal solvents include, for example, alkanols containing at least about 12 carbon atoms, alkanediols containing at least about 12 carbon atoms, monocarboxylic acids containing at least about 12 carbon atoms, esters and amides of such acids, aryl sulfonamides and hydroxyalkyl-substituted arenes. Specific preferred thermal solvents include: tetradecan-1-ol, hexadecan-1-ol, octadecan-1-ol, dodecane-1,2-diol, hexadecane-1,16-diol, myristic acid, palmitic acid, stearic acid, methyl docosanoate, 1,4-bis(hydroxymethyl)benzene, and p-toluenesulfonamide.

In a preferred embodiment, in the transfer material layer not more than 5% by weight of the material present in the layer should have a molecular weight higher than that of the highest molecular weight dye in the dye-containing phase. The presence of higher amounts of high molecular weight species, particularly polymeric species, results in undesirable, more viscous melts under imaging conditions which can adversely affect transfer of the imaging material to the receiver sheet. Further, this feature of the transfer material layer allows the layer to be coated from a solution which has a relatively low viscosity. It is preferred that the transfer layer include not more than about 2% by weight, and particularly preferably not more than about 1% by weight, of components having a molecular weight higher than that of the highest molecular weight dye in the dye-containing phase. Optimally, the thermal transfer material layer does not include any such higher molecular weight species.

The amount of dye(s) present in the transfer layer can vary over a wide range dependent primarily upon the particular dye(s) utilized, the intended imaging application and the desired results. The requisite dye concentration for any specific transfer layer may be determined by routine scoping experiments.

It is desirable to keep the transfer material layer as thin as possible, consistent with good imaging characteristics, especially the maximum optical density of the image, which typically should be at least about 1.5. The transfer material layer typically has a thickness not greater than about 1.5 $\mu$m, preferably not greater than about 1 $\mu$m. Preferred systems can use transfer material layers having a thickness not greater than about 1.0 $\mu$m or even less; satisfactory imaging characteristics and optical densities have been achieved at transfer layer coating weights as low as 0.5 g $m^{-2}$, corresponding to a thickness of about 0.5 $\mu$m. Preferred thermal transfer material layers also produce liquefied transfer layers having melt viscosities below about 1 Pa s and relatively low surface energy, or surface tension. It is particularly preferred to utilize transfer layers having melt viscosities below about 0.5 Pa s. With such thin layers, low melt viscosities and low surface energies, the nanoporous receiving elements having a uniformly voided structure with a porous surface, in which the proportion of the volume of the layer that is void is between about 40% and about 70%, and in which the pore diameter distribution, sampled at regularly spaced intervals, is such that at least about 50% of diameters larger than 30 nm are smaller than about 300 nm, and at least about 95% of diameters larger than 30 nm are smaller than about 1000 nm, may be used to produce images having a glossy appearance. According to a preferred embodiment of the invention the melt viscosity of the thermal transfer material is sufficiently low at the melting point of the crystalline thermal solvent to allow substantially all the thermal transfer material to enter the pores of the receiver material.

The ability to use the nanoporous receiver element of the invention is an important advantage as compared with conventional thermal mass transfer processes. In such conventional processes, the transfer layer comprises a dye or pigment dissolved or dispersed in a vehicle, typically a wax and/or a synthetic polymer. Because of the need to keep the dye or pigment uniformly dissolved or dispersed in the vehicle both during the coating process used to form the transfer layer and during storage and transportation of the donor sheet (during which the donor sheet may be exposed to substantial changes in temperature, humidity and other environmental variables), in practice the dye or pigment typically comprises less than 25 percent by weight of the transfer layer, so that to secure the optical density (around 1.5) needed for high quality full color images, the transfer layer needs to have a minimum thickness of about 1.5 $\mu$m. If one attempts to increase the proportion of dye in the transfer layer, both the melt viscosity and the surface energy of the transfer layer tend to increase, and thus such conventional systems cannot be used with small-pore receiving sheets.

The thin transfer layers which can be used in the thermal mass transfer imaging system of the present invention, together with the physical characteristics of the amorphous dye solid layers, provide significant advantages as compared with conventional thermal mass transfer processes. When a differential adhesion type process is used, the images produced typically are less susceptible to abrasion than conventional differential adhesion thermal mass transfer images, both because a thinner transfer layer is typically inherently less susceptible to abrasion, and because the amorphous dye solid films used, by virtue of their glassy nature, can produce tough, highly coherent layers. Two phase transfer layers can also substantially reduce the energy per unit area needed for imaging, which is especially advantageous in, for example portable printers, or in printers which use imagewise absorption of radiation to effect imaging, as discussed below. If, however, protection against abrasion or other adverse environmental factors (such as ultra-violet radiation which might tend to cause fading of the image, or solvents used to wash the image) is desired, a protective overcoat may be placed over the transfer layer on the receiving sheet. Such a protective overcoat could be applied by hot lamination or a similar technique, but is conveniently thermally transferred over the image using the same thermal head or other head source used for the imaging method itself; in a multi-color method, the protective overcoat essentially becomes an extra "color" which is transferred in the same manner as the other colors, except of course that the overcoat will normally be transferred to cover the entire image rather than only selected pixels.

Although conventionally the image is printed on an image-receiving layer coated on an opaque substrate and a clear protective overcoat layer is laminated over it, alternatively the substrate onto which the image-receiving layer is coated may be clear and an opaque protective layer may be laminated over the image-receiving layer. In the latter case, the image will be viewed through the clear substrate so a mirror-image of the final image must be printed onto the image-receiving layer. The advantage of this embodiment is that it is easier to obtain clear substrate materials than it is to obtain smooth opaque substrate materials.

The imaging method steps can be carried out by conventional techniques that will be familiar to those skilled in the art of thermal mass transfer imaging. Thus, the heating of the transfer layer may be effected using thermal heads of the linear or traversing types, or hot metal dies. Alternatively, the heating of the transfer layer may be effected by imagewise exposure of the transfer layer to radiation absorbed by the transfer layer or a layer in thermal contact therewith. In some cases, the transfer layer itself may not strongly absorb the radiation used for imaging (for example, cost considerations may indicate the use of infra-red lasers which may not be absorbed by visible dyes) and in such cases the transfer layer itself, or a layer in thermal contact therewith, may comprise a radiation absorber which strongly absorbs the radiation used for imaging. If desired, the substrate itself may contain the radiation absorber, or the radiation absorber could be, for example, in a separate layer disposed between the transfer layer and the substrate; this might be desirable, for example, to prevent the radiation absorber being transferred to the receiving sheet together with the transfer layer.

Although the thermal transfer recording system of the invention may most commonly be used to produce visible images to be viewed by the human eye, it is not restricted to such images and may be used to produce non-visible images intended for various forms of machine reading. For example, the present invention may be used to form security codes, bar codes and similar indicia, for example on security and identification documents, and such security and other codes may have "colors" in the infra-red or ultra-violet regions so that the security codes are not obvious to casual inspection but can be read by well known techniques. Accordingly, the term "dye" is used herein to refer to a material which selectively absorbs certain wavelengths of electromagnetic radiation, and should not be construed as restricted to materials which have colors visible to the human eye. The term "color" should be understood in a corresponding manner. The present recording method may also be used to form arrays of colored elements which are not typically thought of as "images", for example color filters for use in liquid crystal displays and other optical or electronic systems.

Recording techniques for use in thermal imaging methods are well known in the art and thus extensive discussion of such techniques is not required here. The thermal mass transfer imaging system of the invention encompasses any suitable thermal recording technique.

As is known to those skilled in the thermal transfer recording art, to produce a full color visible thermal mass transfer image it is necessary to transfer at least three different colored transfer layers to the receiving sheet; typically one uses cyan, magenta and yellow (CMY) or cyan, magenta, yellow and black (CMYK) transfer layers. In one embodiment of the thermal mass transfer imaging system of the invention, the various colored transfer layers can be coated on separate substrates and each transfer layer imaged with a separate thermal head or other heat source. In this embodiment, the printing apparatus needed to do so must provide accurate registration of the separate colored images. In another preferred embodiment, the donor sheet is formed by coating the various transfer layers as a sequential array of color imaging areas or "patches", on a single web of substrate in the manner described, for example in U.S. Pat. No. 4,503,095. One patch of each color is used to image a single receiving sheet, the patches being contacted successively with the receiving sheet and being imaged by a single head. Since only a single web (with, in practice, one feed spool and one take-up spool) and single print head are required, the printing apparatus can be made compact.

In multicolor embodiments it is preferred to transfer the different color thermal transfer materials in increasing order of viscosity, i.e., the least viscous color material first followed by the next least viscous and finally the most viscous (assuming all the thermal transfer materials have substantially the same thickness and surface tension). Further, in multicolor embodiments of the thermal transfer imaging system of the invention it is preferred to incorporate a different thermal solvent in each differently colored thermal transfer material layer. In a preferred full color embodiment which utilizes three donor elements, each having a differently colored thermal transfer material, e.g., cyan, magenta and yellow, it is preferred to incorporate one thermal solvent in each transfer layer with at least one of the thermal transfer layers having a thermal solvent which is different than the thermal solvent(s) present in the other thermal transfer layers. It has been found that where the same thermal solvent is used in two or more layers there appears to be a tendency for "blooming" to occur in the final image, i.e., undesirable crystals to form at the surface of the image.

EXAMPLES

The thermal transfer recording system of the invention will now be described further in detail with respect to specific preferred embodiments by way of examples, it being understood that these are intended to be illustrative only and the invention is not limited to the materials, procedures, amounts, conditions, etc., recited therein. All parts and percentages recited are by weight unless otherwise specified.

Example I

This example illustrates the preparation of four receiver elements of the present invention.

Receiver Element A

An image-receiving layer coating fluid was prepared as follows:

Fumed silica Cab-O-Sperse PG 002 (562.8 g of a 20% aqueous dispersion stabilized with potassium hydroxide, having a surface area of approximately 200 square meters per gram of silica, available from Cabot Corporation, Billerica, Mass.) was added to deionized water (115.3 g) with mechanical stirring at 200 rpm over a period of 15 minutes. Stirring was continued at 200 rpm as further components were added in the sequence described below. 1-Propanol (33.8 g) was added and mixed for 30 minutes, following which acetic acid (0.9 g) was added and mixed for 30 minutes, following which glycerin (5.9 g) was added and mixed for 30 minutes. Then the stirring rate was increased to 500 rpm, and poly(vinyl alcohol) (281.4 g of a 10% aqueous solution of Airvol-540) was added over a period of 60 minutes. The resulting aqueous coating fluid contained 14.63% solids. The ratio of silica to binder was 4:1.

The fluid so prepared was coated onto a substrate obtained by laminating a clear poly(ethylene terephthalate) web approximately 12.2 microns in thickness (48 gauge T-813, available from E. I. DuPont de Nemours, Wilmington, Del.) to an opaque, voided, oriented polypropylene film base containing an inorganic pigment, approximately 154.2 microns in thickness (FPG200 of nominal 8 mil thickness, available from Yupo Corporation, Chesapeake, Va.) with a polyurethane adhesive. The image-receiving layer coating was applied to the surface of the poly(ethylene terephthalate) web opposite to that which had been laminated to the voided, oriented poypropylene material. After drying, the coating coverage of the image-receiving layer was approximately 8 g/m$^2$.

The gloss of the coating so obtained was measured using a glossmeter (Model 4520, available from BYK-Gardner Corporation, Columbia, Md.) and found to be 43 gloss units at 60° to the normal, and 33 gloss units at 20° to the normal.

Receiver Element B

An image-receiving layer coating fluid was prepared as follows:

a. An aqueous solution of an ammonium salt of Carboset 526 was prepared as follows:

Carboset 526 powder (120 g) was added to deionized water (1864.4 g) with moderate agitation (so as to avoid foaming) at 20–25° C. Then concentrated aqueous ammonia (15.6 g of a 30% aqueous solution) was added, and the temperature of the mixture was raised to 80–85° C. and maintained at this temperature for approximately 2 hours. The temperature of the solution was then lowered to about 30° C. and the solution was filtered.

b. A solution of epoxysilane Silquest A-186 was prepared as follows:

Silquest A-186 (100.0 g) was added to isopropanol (684.3 g) with moderate stirring. Then water (191.6 g) was added over a period of approximately one minute, with continued agitation, and the resulting solution was stirred at room temperature for 10 minutes. Acetic acid (5 g) was then added over a period of 15 seconds, and the solution was stirred for 30 minutes. The useful life of this solution is about 4 hours at room temperature.

c. Deionized water (333.9 g) was added to fumed silica Cab-O-Sperse PG 002 (795.2 g of a 20% aqueous dispersion stabilized with potassium hydroxide, having a surface area of approximately 200 square meters per gram of silica) with mechanical stirring at 300 rpm. After addition was completed, the mixture was stirred at 300 rpm for a further 5 minutes. Then poly(vinyl alcohol) (75.7 g of a 7% aqueous solution of Airvol-540 was added, and the mixture was stirred for 20 minutes at 400 rpm. The following materials were then added in sequence: a 6% aqueous solution of Carboset 526, prepared as described in a. above (795.2 g, added very slowly), concentrated aqueous ammonia (82.5 g of a 30% solution), and a 10% solution of Silquest A-186, prepared as described in b. above (82.5 g). After these additions had been completed, the mixture was stirred at 500 rpm for a period of 30 minutes, to afford a coating fluid which contained 11% solids. The ratio of silica to binder was 3:1, and the ratio of Carboset 526 to Airvol-540 was 9:1.

The image-receiving layer coating fluid so prepared was coated onto the same substrate as was used for Receiver Element A. above. After drying, the coating coverage of the image-recceiving layer was approximately 8 g/m$^2$.

The gloss of the image-receiving layer so obtained was measured using the same glossmeter described above and found to be 39 gloss units at 60° to the normal, and 31 gloss units at 20° to the normal.

Receiver Element C

An image-receiving layer coating fluid was prepared as follows:

a. An aqueous solution of an ammonium salt of Carboset 526 was prepared as described above for Receiver Element B.).

b. A solution of silane Silquest A-174 was prepared as follows:

Water (22.5 g) was added to isopropanol (22.5 g) with moderate stirring. Then Silquest A-174 (5.0 g) was added.

c. A solution of epoxysilane Silquest A-187 was prepared as follows:

Water (22.5 g) was added to isopropanol (22.5 g) with moderate stirring. Then Silquest A-187 (5.0 g) was added. The useful life of this solution is about 4 hours at room temperature.

d. Deionized water (166 g) was added to fumed silica Cab-O-Sperse PG 002 (544.8 g of a 20% aqueous dispersion stabilized with potassium hydroxide, having a surface area of approximately 200 square meters per gram of silica) with mechanical stirring. After addition had been completed, poly(vinyl alcohol) (51.9 g of a 7% aqueous solution of Airvol-540 was added. The following materials were then added in sequence: a 6% aqueous solution of Carboset 526, prepared as described in a. above (544.8 g, added very slowly), concentrated aqueous ammonia (5.5 g of a 30% solution), a 10% solution of Silquest A-174, prepared as described in b. above (32.7 g), and a 10% solution of Silquest A-187 (prepared as described in c. above, 54.5 g). After these additions had been completed, the mixture was stirred at 500 rpm for a period of 30 minutes, to afford a coating fluid that contained 11% solids.

The image-receiving layer coating fluid so prepared was coated onto the same substrate as was used for Receiver Element A. above. After drying, the coating coverage of the image-receiving layer was approximately 8 g/m$^2$.

The gloss of the coating so obtained was measured using the same glossmeter described above and found to be 37 gloss units at 60° to the normal, and 27 gloss units at 20° to the normal.

Receiver Element D

An image-receiving, layer coating fluid was prepared as follows:

a. An aqueous solution of an ammonium salt of Carboset 526 was prepared as described above for Receiver Element B.).

b. A solution of silane Silquest A-174 was prepared as follows:

Isopropanol (90 g) was added to water (90 g) with moderate stirring. Then Silquest A-174 (20.0 g) was added, with stirring, over a period of 30 minutes.

c. A solution of epoxysilane Silquest A-187 was prepared as follows:

Isopropanol (112.5 g) was added to water (112.5 g) with moderate stirring. Then Silquest A-187 (25.0 g) was added, with stirring, over a period of 30 minutes. The useful life of this solution is about 4 hours at room temperature.

d. The following materials were mixed with mechanical stirring, in sequence: fumed silica Cab-O-Sperse PG 002 (672.8 g of a 20% aqueous dispersion), fumed silica Cab-O-Sperse PG 001 (84.1 g of a 30% aqueous dispersion), colloidal silica Nalco 2326 (56.07 g of a 15% aqueous dispersion, available from Nalco Chemical Company, Naperville, Ill. 60563-1198), and deionized water (192 g). After addition had been completed, poly(vinyl alcohol) (79.94 g of a 6.78% aqueous solution of Airvol-540) was added over a period of 20 minutes. The following materials were then added in sequence: a 6% aqueous solution of Carboset 526, prepared as described in a. above (840 g, added over a period of 90 minutes), an aqueous ammonia solution (24 g of a solution prepared by combining 16 g of deionized water with 8 g of a concentrated aquous ammonia solution, added over a period of 5 minutes), and a solution of Silquest A-174, prepared as described in b. above (50.4 g of a 10% solution). The mixture prepared as described above (1,851.88 g of an 11.45% solution), water (68.6 g), a 10% solution of Silquest A-187 (prepared as described in c. above, 79.52 g) were then combined in a vortex mixer to afford a coating fluid that contained 11% solids.

The fluid so prepared was coated onto a substrate obtained by laminating a clear poly(ethylene terephthalate) web approximately 24.4 microns in thickness (96 gauge T-813, available from E. I. DuPont de Nemours, Wilmington, Del.) to both sides of an opaque, voided, oriented polypropylene film base containing an inorganic pigment, approximately 116 microns in thickness (FPG200 of nominal 6 mil thickness, available from Yupo Corporation, Chesapeake, Va.) with a polyurethane adhesive. The image-receiving layer coating was applied to the surface of the poly(ethylene terephthalate) web. After drying, the coating coverage of the image-receiving layer was approximately 6.5 g/m$^2$.

The gloss of the coating so obtained was measured using the same glossmeter described above and found to be 37 gloss units at 60° to the normal, and 38 gloss units at 20° to the normal.

Example II

This example illustrates the thermal printing of donor elements having a layer of thermal transfer material comprising an amorphous dye-containing phase and a thermal solvent as described above onto a receiver element of the present invention.

Donor elements for thermal mass transfer imaging were prepared as follows:

A coating solution was prepared containing the dye specified below and an appropriate amount of the thermal solvent specified below in 1-butanol. This solution was coated onto a poly(ethylene terephthalate) film base of 4.5 $\mu$m thickness with a slip coating for thermal printing on the reverse side (supplied by International Imaging Materials, Inc., Amherst, N.Y.), and the coating was dried.

| Coating | Dye | Thermal Solvent | Dye:TS ratio by wt | Thickness |
|---|---|---|---|---|
| Cyan | Solvent Blue 70 | [2]TS I | 1:1.67 | 0.75 $\mu$ |
| Magenta | [1]Dye I | [3]TS II | 1:2.8 | 0.45 $\mu$ |
| Yellow | Solvent Yellow 88 | [3]TS II | 1:2.4 | 0.62 $\mu$ |

[1]Dye I is represented by the formula

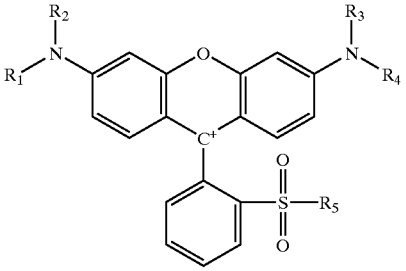

where R1 = R3 = a statistical mixture derived from equal amounts of 2-ethylphenyl, 2,3-dimethylphenyl, 2,4-dimethylphenyl and 2,5-dimethylphenyl; R2 = R4 = methyl; and R5 = O;

[2]N-decan-1-yl-4-nitrobenzamide

[3]N-dodecyl-4-methoxybenzamide

The donor material was printed onto Receiver Element C, prepared as described in Example I above, as follows:

The coated face of the donor material was placed in contact with the image-receiving layer of Receiver Element C, and the resulting assembly was printed using a laboratory test-bed printer equipped with a thermal head KST-87-12MPC8 supplied by Kyocera Corporation, Kyoto, Japan. The following printing parameters were used:

| | |
|---|---|
| Printhead width: | 3.41 inch |
| Resistor size: | 70 × 80 microns |
| Resistor spacing: | |
| Resistance: | 3500 Ohm |
| Voltage: | 19.8 V |
| Print speed: | 2 inches/second (1.6 msec per line) |
| Pressure: | 1.5 lb/linear inch |
| Donor peeling: | 90 degree angle, 0.1–0.2 seconds after printing |
| Dot pattern: | Odd-numbered and even-numbered pixels printed alternately in successive lines; one pixel (70 micron) spacing between lines in paper transport direction. |

Ten steps of different energy were printed, the current pulse for a given pixel in each step varying between 0.1–1 msec per line.

The colored donor elements were printed in the order cyan, then magenta, then yellow. Following printing of the colored donor elements, an overcoat was applied. The overcoat material was prepared by coating a solution of a polymer, Paraloid acrylic resin B44 (available from Rohm and Haas Company, Philadelphia, Pa.) in 2-butanone onto the poly(ethylene terephthalate) film base of 4.5 $\mu$m thickness described above to a dried thickness of 1.5 $\mu$m. The overcoat was printed in the same manner as the colored donor elements, except that the alternating dot pattern was not used; instead, every pixel was energized in every line. The voltage used was 19.8V, the print speed was 2 inches/second (1.6 msec per line) and the current pulse for each pixel was 1.36 msec.

Following printing, the optical densities for each color were measured using a spectrophotometer supplied by GretagMacbeth AG, Regensdorf, Switzerland. Table I below shows the densities obtained for each color, as a function of the energy supplied by the print head.

TABLE I

| Energy, J/cm$^2$ | Y | M | C |
|---|---|---|---|
| 0.147 | 0.05 | 0.05 | 0.05 |
| 0.293 | 0.06 | 0.08 | 0.06 |
| 0.440 | 0.30 | 0.29 | 0.17 |
| 0.586 | 0.63 | 0.62 | 0.44 |
| 0.733 | 1.46 | 1.22 | 1.15 |
| 0.879 | 1.56 | 1.45 | 1.45 |
| 1.026 | 1.58 | 1.59 | 1.71 |
| 1.172 | 1.58 | 1.69 | 1.83 |
| 1.319 | 1.58 | 1.70 | 1.88 |
| 1.466 | 1.57 | 1.66 | 1.75 |

As can be seen, acceptable $D_{max}$ densities and color gradations were obtained for all three colors.

Example III

This example illustrates the reduced optical density change under humid conditions which may be achieved through use of a hydrophobic binder in the receiving layer of the present invention, as compared to the change in optical density occurring with the use of a hydrophilic binder. As described previously above, changes in optical density may be caused by diffusion of dyes away from the dots originally printed, a process which may be accelerated in humid environments.

A. Preparation of Receiver Elements III/1–III/4

Four receiver elements were prepared by methods similar to those described in Example I above. The image-receiving layers of all four of these receiver elements contained the same particulate material (Cab-O-Sperse PG 002). The formulations varied, however, in the hydrophobicity of the binder constituents. Receiver element III/1 (prepared as described in Example I, Receiver Element A above) had a dry weight ratio of 3:1 of silica to a hydrophilic binder, poly(vinyl alcohol) Airvol 540.

Receiver element III/2 (prepared as described in Example I, Receiver Element B above, except that the Silquest A-186 was omitted from the coating fluid) had a dry weight ratio of 3:1 of fumed silica to a hydrophobic binder that was comprised of a 9:1 blend of Carboset 526 and poly(vinyl alcohol) Airvol 540. Receiver element III/2 contained a more hydrophobic binder composition than Receiver element III/1.

Receiver element III/3 (prepared as described in Example I, Receiver Element B above) included an epoxysilane, Silquest A-186, added at a level such that the final dry ratio was 72.3% silica, 21.7% Carboset 526, 2.41% Airvol 540, and 3.61% Silquest A-186. Receiver element III/3 contained a more hydrophobic binder composition than Receiver element III/1. The hydrophobicity of Receiver element III/3 was approximately equal to that of Receiver element III/2, but the former incorporated a cross-linking element not present in Receiver element III/2.

Receiver element III/4 (prepared as described in Example I, Receiver Element B above, except that poly(vinyl alcohol) Airvol 540 was omitted from the coating fluid) had a binder that was comprised entirely of Carboset 526 such that the final dry ratio was 72.3% silica, 24.1% Carboset 526, and 3.61% Silquest A-186. Receiver element III/4 contained the most hydrophobic binder composition of all four receiver elements tested.

These image-receiving layer formulations were coated onto the same substrate as that described in Example I above to a dried coverage of approximately 10 g/m$^2$.

B. Printing onto Receiver Elements

Donor sheets for thermal transfer in the following imaging examples were prepared as described in Example II above, with the following composition:

| Coating | Dye | Thermal Solvent | Dye:TS ratio | Thickness |
|---|---|---|---|---|
| Magenta | Dye I | TS 2 | 1:2.4 | 0.45 $\mu$ |
| Yellow | Solvent Yellow 88 | TS 2 | 1:2 | 0.53 $\mu$ |

The donor material was printed onto the receiver materials as described in Example II above, except that the printing voltage was 19.5V.

C. Conditioning Prints in Humid Environment

Following printing, the reflection density in each of the ten printed areas was measured using a GretagMacbeth spectrophotometer. The printed samples were then stored in a chamber at 40° C. and 90% relative humidity environment for a period of 16 hours, after which the reflection densities were read again. Tables II and III show the changes in density for the four test receiving layers, obtained by subtracting the readings before exposure to humid conditions from those following said treatment.

TABLE II

| | Magenta | | | |
|---|---|---|---|---|
| Step | III/1 | III/2 | III/3 | III/4 |
| 1 | 0.003 | 0.000 | 0.000 | 0.000 |
| 2 | 0.060 | 0.003 | 0.003 | 0.000 |
| 3 | 0.073 | 0.007 | 0.003 | 0.003 |
| 4 | 0.087 | 0.007 | 0.003 | 0.000 |
| 5 | 0.100 | 0.010 | 0.000 | 0.003 |
| 6 | 0.133 | 0.013 | 0.007 | 0.003 |
| 7 | 0.140 | 0.017 | 0.007 | 0.003 |
| 8 | 0.153 | 0.037 | 0.007 | 0.007 |
| 9 | 0.083 | 0.050 | 0.023 | 0.030 |
| 10 | −0.013 | 0.037 | 0.040 | 0.050 |

TABLE III

| | Yellow | | | |
|---|---|---|---|---|
| Step | III/1 | III/2 | III/3 | III/4 |
| 1 | 0.000 | 0.000 | 0.000 | 0.000 |
| 2 | 0.033 | 0.007 | 0.003 | 0.003 |
| 3 | 0.050 | 0.007 | 0.000 | 0.000 |
| 4 | 0.063 | 0.010 | 0.000 | 0.000 |
| 5 | 0.080 | 0.013 | 0.000 | 0.000 |
| 6 | 0.090 | 0.013 | 0.000 | 0.000 |
| 7 | 0.093 | 0.020 | 0.000 | 0.000 |
| 8 | 0.093 | 0.020 | 0.000 | 0.003 |
| 9 | 0.033 | 0.003 | −0.003 | 0.000 |
| 10 | −0.063 | −0.037 | −0.013 | −0.013 |

Receiver element III/1, in which a hydrophilic binder was present, was observed to show much greater increases in step densities for both magenta and yellow dyes as compared to the hydrophobic binder systems of receiver elements III/2, III/3 and III/4. Receiver element III/3 shows that the addition of the epoxysilane to the receiver formulation provided a further slight reduction in humidity induced density increase as compared to element III/2. Receiver element III/4 shows that removal of the small amount of hydrophilic polyvinyl alcohol provided a further slight reduction in humidity induced density increase as compared to element III/3.

Example IV

This example illustrates the improvement in the durability of the image-receiving layer obtained by the use of an epoxy-silane material in the formulation.

A. Preparation of Receiver Elements IV/1–IV/3

Three receiver layers were prepared in a manner similar to that described in Example I, Receiver Element B In each, the dry coverage of the image-receiving layer was approximately 10 g/m$^2$, and had the following composition (dried weight percentages):

| | |
|---|---|
| Cab-O-Sperse PG 002 | 72.3% |
| Carboset 526 | 21.7% |
| Airvol 540 | 2.4% |
| Silane | 3.6%. |

The following silanes were used:

| Coating | Silane |
|---|---|
| IV/1 | Silquest A-174 (gamma-methacrylamidopropyl-trimethoxysilane) |
| IV/2 | Silquest A-186 (beta-(3,4-epoxycyclo-hexyl)ethyltrimethoxysilane) |
| IV/3 | Silquest A-187 (gamma-glycidoxy-propyltrimethoxysilane) |

The silanes used in coatings IV/2 and IV/3 contained epoxide groupings, whereas that used in coating IV/1 did not.

B. Printing onto Receiver Elements

Printing was carried out as described in Example III above, using the magenta donor element described therein and the three Receiver elements IV/1–IV/3.

The improvement in receiver layer durability was demonstrated by the ability to maintain a high image density as the printing energy was increased. A decrease in density at the highest energy steps has been shown to be the result of colorless void areas in the center of the image dots with a corresponding magenta spot observed on the donor web after peeling. This void area is attributed to softening of the organic binder in the hot center of these highest dots, causing material to be pulled out of the receiver and preferentially adhered to the donor web.

The durability enhancement resulting from the use of epoxysilanes in the receiving layer has been observed to be greatest following a certain "aging-in" period. In some instances, aging may be achieved by high temperature drying as a part of the coating procedure, or in cases where the maximum temperature must be limited, longer times at lower temperatures have proven effective. In particular, a storage period of three weeks at room temperature has been shown to provide increased image-receiver layer durability in comparison to use of the receiver element immediately following coating.

Table IV below shows the magenta step wedge densities obtained by printing onto the three receiver elements prepared in A. above. Columns denoted as "A" show the imaging results for receiver elements that were printed immediately after the coating process. Columns denoted as "B" show the printing results obtained for the same receivers after conditioning for 30 minutes at 100° C. in order to simulate the "aging-in" effect described above.

TABLE IV

| | Energy | IV/1 | | IV/2 | | IV/3 | |
|---|---|---|---|---|---|---|---|
| Step | (J/cm^A2) | A | B | A | B | A | B |
| 1 | 0.18 | 0.04 | 0.04 | 0.03 | 0.04 | 0.03 | 0.03 |
| 2 | 0.37 | 0.05 | 0.04 | 0.05 | 0.05 | 0.03 | 0.04 |
| 3 | 0.55 | 0.27 | 0.26 | 0.27 | 0.27 | 0.25 | 0.25 |
| 4 | 0.73 | 0.61 | 0.56 | 0.59 | 0.59 | 0.54 | 0.56 |
| 5 | 0.92 | 1.42 | 1.35 | 1.36 | 1.33 | 1.27 | 1.27 |
| 6 | 1.10 | 1.57 | 1.62 | 1.56 | 1.61 | 1.53 | 1.60 |
| 7 | 1.28 | 1.71 | 1.68 | 1.62 | 1.63 | 1.55 | 1.62 |
| 8 | 1.46 | 1.61 | 1.66 | 1.59 | 1.65 | 1.55 | 1.62 |
| 9 | 1.65 | 1.32 | 1.46 | 1.41 | 1.58 | 1.42 | 1.57 |
| 10 | 1.83 | 1.03 | 1.19 | 1.14 | 1.51 | 1.26 | 1.53 |

Receiver element IV/1 contained a silane that does not have an epoxide grouping, and demonstrated the high energy "pull-out" effect. The highest magenta density of 1.71 was attained at Step 7, which was printed with 1.28 J/cm$^2$. Step 10, which was printed at 1.83 J/cm$^2$, showed a density of only 1.03. Microscopic examination revealed void areas at the center of most of the dots in Step 10.

After the 100° C. conditioning, only a slight improvement was seen (Column B: Step 10 density increased only to 1.19). In contrast, after 100° C. conditioning of Receiver elements IV/2 and IV/3 (made with epoxide-containing silanes), much higher Step 10 densities (1.51 and 1.53, respectively) were attained. Microscopically, the transferred dots in these two Receiver elements were observed to be of uniform magenta density.

Example V

This Example illustrates the use of a wash coating that is deposited on the image-receiving receiver layer in such a manner that additional addenda such as photostabilizers may be introduced into the receiving layer.

A. Deposition of the Wash Coating

Receiver Element C, prepared as described in Example 1 above, was overcoated with solutions of the following photostabilizers in the indicated solvents, to a dried coverage indicated of the photostabilizer. Because the image-receiving layer coating on the surface of Receiver Element C is porous, the coating solutions penetrated the pores of the receiver. Following drying of the solvent, therefore, the photostabilizers were incorporated within the porous structure of the image-receiving layer of Receiver Element C.

| Receiver coating | Photostabilizer | Solvent | Coverage of photostabilizer ($g/m^2$) |
|---|---|---|---|
| V/1 | None | — | — |
| V/2 | Tinuvin 292* | 2-Propanol | 0.1 |
| V/3 | Copper(II) bis(trifluoroacetylacetonate) | 2-Propanol | 0.05 |
| V/4 | Copper(II) sulfate | Water | 0.1 |
| V/5 | Copper(II) sulfate + aluminum chlorohydrate (1:4 ratio) | 10% 2-propanol in water | 0.1 |

*Tinuvin 292 is a hindered amine light stabilizer available from Ciba Specialty Chemicals Corporation, Tarrytown, NY.

B. Printing and Photofading Results

Printing was carried out as described in Example II above, using the magenta donor element described therein and the five Receiver elements V/1–V/5. The magenta dye was chosen for this experiment, as it had previously been shown to be particularly susceptible to photofading in the absence of a photostabilizer.

Following printing of the colored donor element, an overcoat was applied as described in Example II above, except that the overcoat material was prepared by coating the solution described below onto the poly(ethylene terephthalate) film base of 4.5 micron thickness described in Example II to a dried thickness of 1.5 microns. Overcoat coating fluid:

Acrylic resin Paraloid B60 (available from Rohm and Haas Company, Philadelphia, Pa., 13.84 g), Tinuvin 328 (available from Ciba Specialty Chemicals Corporation, Tarrytown, N.Y., 1.0 g) and Tinuvin-900 (available from Ciba Specialty Chemicals Corporation, Tarrytown, N.Y., 1.65 g) were dissolved in 2-butanone (83.5 g).

The printed samples were exposed both to a Xenon arc (approximately 10,000 ft. candles) for 3 days, and to fluorescent lighting (2,500 ft. candles) for 18 days. The percentage dye loss was measured by comparing the results of density measurements taken before and after exposure. The results obtained are shown in Table V below.

TABLE V

| Receiver coating | Xenon arc, 3 days | Fluorescent lighting, 18 days |
|---|---|---|
| V/1 | 70% loss | 64% loss |
| V/2 | 50% loss | 48% loss |
| V/3 | 50% loss | — |
| V/4 | 40% loss | — |
| V/5 | 30% loss | — |

Significantly greater dye loss is seen for receiver element V/1 (having no wash coating of a photostabilizer) than for receiver elements V/2, V/3, V/4 and V/5, which included wash coatings of photostabilizers.

Example VI

This Example illustrates the characterization of the porosity and the pore diameter distribution in three image-receiving layers of the present invention. The samples used, receiver elements VI/1, VI/2 and VI/3, were the receiving elements of Example I, parts B, C and D, prepared as described above, except that the coated coverages were 0.928, 0.674 and 0.69 $mg/cm^2$, respectively.

The uniformity of pore distribution within the image-receiving layer was established by Field Emission Scanning Electron Microscopy (FESEM) of a cross section of receiver element VI/1. A sample of the receiver element was sectioned by microtomy. The faced-off portion of the sample (i.e., the sample remaining after the section had been removed) was coated with a conductive film of C-Pt by evaporation. The sample was studied in the secondary imaging mode of the Field Emission Scanning Electron Microscope at low (2) kV, 45 degree tilt, to show both the internal and surface structure, at a working distance of 16 mm. There was no discernable difference between the internal and the surface structure of the sample.

Having thus established that the image-receiving element was uniformly porous, the porosity of receiver elements VI/1–VI/3 was characterized in the following manner:

a. FESEM analysis of samples was used to generate an image of the surface of the image-receiving layer. Representative samples of about 10×10 mm were selected from the receiver element of interest. Samples were mounted in appropriate sample holders and coated with a conductive carbon film using an evaporative coater. They were then imaged with secondary electrons on the Field Emission Scanning Electron Microscope (FESEM) at 10,000× magnification, 2.0 KV accelerating voltage, 0 tilt, and 17.0 mm working distance. Images were captured digitally in 8-bit grayscale at a resolution of 1024×819 pixels for image analysis;
b. Optical microscopy of a cross section of each receiver element was used to measure the thickness of the image-receiving layer. Representative samples of receiver material were sectioned by microtomy. The faced-off portion of the sample (i.e., the sample remaining after a section had been removed) was then examined via bright field reflected light microscopy at 500× magnification. Images were captured digitally at 800×600 pixel resolution. The thickness of the receiver coating was measured from the resulting image using appropriate software. The measured thicknesses were 12.7, 8.57 and 9.59 $\mu$m, respectively, for the receiver elements VI/1, VI/2 and VI/3;
c. From knowledge of the coating coverage and the density of materials coated (which was 1.74 $g/cm^3$ for the receiver elements VI/1, VI/2 and VI/3), the thickness that the coating would have had, had it contained no voids, was determined, and this value was compared with the measured thickness to give the void fraction of the image-receiving layer (58.01%, 54.81% and 58.65%, respectively, for the receiving elements VI/1, VI/2 and VI/3);

d. Image Analysis of the FESEM image of the receiver surface was then carried out. Because, as shown above, the image-receiving layer is uniformly porous, it is possible to treat the surface image as that of an arbitrary planar slice through the image-receiving layer. Therefore, the image was first thresholded such that the relative areas of void and solid material were the same as the overall relative volumes of void and solid material in the layer. Then, the widths of the void areas were calculated, as sampled along regularly spaced horizontal lines across the image, to give the statistical distribution of void diameters. For each receiver element, this analysis was performed on nine different surface images, and the results were averaged. The distribution of pore sizes larger than 30 nm so obtained is illustrated in FIG. 3.

Figure 3:
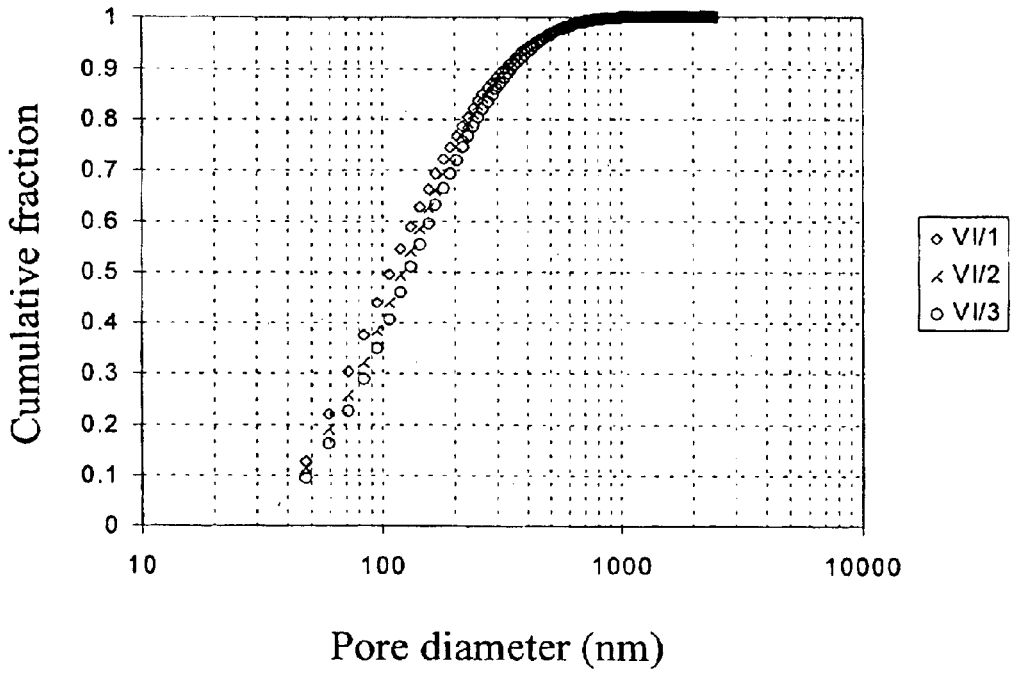
FIG. 3 illustrates the pore diameter distribution of an image-receiving layer of the present invention.

As can be seen from FIG. 3, in receiver elements VI/1–VI-3 of the present invention, about 50% of the pores larger than 30 nm are smaller than about 150 nm, and about 95% of pores larger than 30 nm are smaller than about 500 nm.

Example VII

This Example illustrates the effect of the smoothness of the image-receiving layer on the granularity of the printed image.

An image-receiving layer was coated onto five different substrates, VII/1–VII/5, described below, using the procedure described in Example 1, Part D above.

Substrates

VII/1: An opaque, voided, oriented polypropylene film base containing an inorganic pigment, approximately 154 microns in thickness (FPG200 of nominal 8 mil thickness, available from Yupo Corporation, Chesapeake, Va.);

VII/2: A substrate obtained by laminating a clear poly (ethylene terephthalate) web approximately 24.4 microns in thickness (96 gauge T-813, available from E. I. DuPont de Nemours, Wilmington, Del.) to both sides of an opaque, voided, oriented polypropylene film base containing an inorganic pigment, approximately 116 microns in thickness (FPG200 of nominal 6 mil thickness, available from Yupo Corporation, Chesapeake, Va.) with a polyurethane adhesive;

VII/3: A substrate obtained by extruding a low density polyethylene layer 15.25 microns in thickness onto one side of an opaque, voided, oriented polypropylene film base containing an inorganic pigment, approximately 154 microns in thickness (FPG200 of nominal 8 mil thickness, available from Yupo Corporation, Chesapeake, Va.), and a layer 12.2 microns in thickness of high density polyethylene onto the opposite side of said film base, and applying the image-receiving layer to the side of the substrate bearing the low density polyethylene layer;

VII/4: A substrate 180 microns in thickness comprising an opaque, voided, oriented polypropylene core coated on both sides with a clay-containing layer (PEPA PI-180, available from Nan-Ya plastics, Taiwan);

VII/5: A substrate comprising the material described in VII/4 above, coated on one side with a smoothing layer comprising 0.6 g/m$^2$ of polyethylene acrylic acid, type 4983R, available from Michelman Company, and applying the image-receiving layer to the side coated with the smoothing layer.

The resulting coatings were analyzed for gloss (using a glossmeter, Model 4520, available from BYK-Gardner Corporation, Columbia, Md.) and surface roughness. Root mean square (RMS) surface roughness over an area of 1.7 mm by 1.9 mm was measured using an optical interferometer WYKO RST, available from Veeco Instruments, Tucson, Ariz. 85706. Three measurements were taken for each coated substrate. The values obtained from these measurements are reproduced in Table VI below.

Each of the coated substrates was then printed upon using the procedure described below.

A Donor Element was Prepared as Follows

A coating solution was prepared containing Solvent Blue 70 and a thermal solvent (N-decan-1-yl-4-nitrobenzamide) in a 1:2 weight ratio in 1-butanol. This solution was coated onto a poly(ethylene terephthalate) film base of 4.5 $\mu$m thickness with a slip coating for thermal printing on the reverse side, and the coating was dried, to give a coverage of 1.0 g/m$^2$. The donor material was printed onto Receiver Elements VII/1–VII-5, prepared as described in above, as follows:

The coated face of the donor material was placed in contact with the image-receiving layer of the Receiver Element, and the resulting assembly was printed using a laboratory test-bed printer. The following printing parameters were used:

| | |
|---|---|
| Thermal print head: | KPT-106-12PAN20, supplied by Kyocera Corporation, Kyoto, Japan |
| Printhead width: | 106 mm |
| Resistor size: | 60 × 60 microns |
| Resistor spacing: | 300 dpi |
| Resistance: | 3100 Ohm |
| Voltage: | 16 V |
| Print speed: | 3 inches/second |
| Pressure: | 2 lb/linear inch |
| Donor peeling: | 90 degree angle, 0.1–0.2 seconds after printing |
| Dot pattern: | Odd-numbered and even-numbered pixels printed alternately in successive lines; 63 micron spacing between lines in paper transport direction. |

An image consisting of uniform areas of different printed density was prepared, the current pulse for a given pixel in each area being a value between 0.1–0.5 msec per line, depending on the density intended to be printed.

Following printing of the colored donor element, an overcoat was applied. The overcoat material was prepared by coating a solution of a polymer, Paraloid acrylic resin B44 (available from Rohm and Haas Company, Philadelphia, Pa.) in 2-butanone onto the poly(ethylene terephthalate) film base of 4.5 $\mu$m thickness described above to a dried thickness of 1.5 $\mu$m. The overcoat was printed in the following manner:

| | |
|---|---|
| Thermal print head: | KPT-106-12MFW4, supplied by Kyocera Corporation, Kyoto, Japan |
| Printhead width: | 106 mm |
| Resistor size: | 70 × 110 microns |
| Resistor spacing: | 300 dpi |
| Resistance: | 3700 Ohm |
| Voltage: | 19 V |
| Print speed: | 3 inches/second |
| Pressure: | 2 lb/linear inch |
| Donor peeling: | 90 degree angle, 0.1–0.2 seconds after printing |
| Dot pattern: | Uniform heating |

Following printing, the image was scanned at 1200 dpi and 14-bit gray scale resolution, using a UMAX Power- LookIII flatbed scanner (available from UMAX Technologies, Inc.). The granularity at a reflection optical density of 0.75 was estimated substantially as described in J. C. Dainty, R. Shaw, Image Science, London 1974, pp. 276 and C. J. Bartleson, Predicting Graininess from Granularity, J. Photogr. Sci., 33, 117 (1985), as described in more detail below.

Granularity is a function of both spatial frequency f and reflection density D. The Noise Power Spectrum (NPS) describes the spatial frequency dependence of the density fluctuations. Noise power spectra N(f, D) were measured at a variety of densities by scanning uniform gray areas with a long narrow slit. For the calculation of NPS the scanned image was subdivided into M 'tiles', and then a one-dimensional microdensitometer slit scan was simulated for each tile. The size of each tile m was determined by the slit dimensions (width a and length h), and the length L of the data sequence used. The settings used were a=1 pixel, h=64 pixel, and L=256 pixel).

The noise power in each spatial frequency channel $f_k$ is $$N(f_k) = \frac{a}{ML}\sum_{m=0}^{M-1}\left|\sum_{l=0}^{L-1}\Delta D_1 e^{-2\pi ikl/L}\right|^2, \tag{1}$$

with spatial frequencies between $f_{min}=1/(L\Delta x)=0.18$ cy/mm and $f_{max}=1/(2\Delta x)=23.6$ cy/mm, where $\Delta x$ is given by the scanner pitch.

In order to estimate the visibility of noise to the human observer, the data so generated was next weighted in color, spatial frequency, and density.

To simulate a spectral response close to that of the human observer, the reflectance signals from the color channels (red, green and blue, or R, B and B) were converted to luminance values, using visual weighting coefficients, and then turned into visual densities:

$$D_1=-\log(0.29R_1+0.6\ G_1+0.11B_1) \tag{2}$$

The noise power spectrum was next weighted in relation to spatial frequency and density. Granularity at any given density D, G(D), represents the RMS fluctuation in density measured with a fixed aperture. Typically, the aperture is chosen to yield the best correlation with the visual perception of graininess. Thus, granularity at a given density G(D) represents a weighted average over the spatial frequency component and is computed from N(f, D) by low-pass filtering with the spatial frequency response E(f) of the human visual system:

$$G(D) = \sigma^2 = \frac{\int\left(\frac{E(f)}{f}\right)^2 N(f, D)df}{\int\left(\frac{E(f)}{f}\right)^2 df} \tag{3}$$

An approximation of the form $$\frac{E(f)}{f} = a\cdot e^{-\left\{\left[\frac{\log(f+a)}{b}\right]^c\right\}} \tag{4}$$

with a=1.8778, b=0.5157 and c=3.53 was used. The eye weighting function $(E(f)/f)^2$ can be considered to be equivalent to a Gaussian weighted aperture with a $2\sigma$ width of 560 $\mu$m, projected onto the image.

Granularity values at density 0.75 were calculated from NPS measured at two gray density steps below and above 0.75, and in both primary print directions. At least 0.5 square inches were evaluated for each NPS, and each measurement was repeated 3 times. A granularity index was computed as $10^3\sigma(D=0.75)$, using equations (3) and (4). Larger granularity index values correspond to more perceptibly grainy images. Acceptable image quality is achieved with granularity index values less than about 6.5.

The granularity values so computed are reproduced in Table VI below.

TABLE VI

| Substrate | 20° gloss | 60° gloss | RMS roughness (standard deviation) (nm) | Granularity index |
|---|---|---|---|---|
| VII/1 | 2 | 11 | 552 (14) | 10.9 |
| VII/2 | 38 | 37 | 200 (17) | 6.6 |
| VII/3 | 15 | 24 | 167 (7) | 4.0 |
| VII/4 | 2 | 15 | 282 (26) | 7.5 |
| VII/5 | 9 | 23 | 225 (21) | 6.2 |

It can be seen from Table VI that there is good correlation between the RMS roughness and the granularity index values, but poor correlation between either of these measurements and the gloss measurements.

Although the invention has been described in detail with respect to various preferred embodiments, it is not intended to be limited thereto, but rather those skilled in the art will recognize that variations and modifications are possible which are within the spirit of the invention and the scope of the appended claims.

What is claimed is:

1. A nanoporous receiver element for use in thermal mass transfer imaging comprising a substrate carrying an image-receiving layer comprising particulate material and binder material, said substrate comprising a layer of a material having a compressibility of at least about 1% under a pressure of 1 Newton per mm$^2$, or, a material having a thickness of less than about 50 $\mu$m and having a compressibility of less than about 1% under a pressure of 1 Newton per mm$^2$; and said image-receiving layer having a void volume of from about 40% to about 70% and a pore diameter distribution wherein at least about 50% of the pores having a diameter of greater than about 30 nm have a diameter less than about 300 nm and at least about 95% of the pores having a diameter greater than about 30 nm have a diameter less than about 1000 nm.

2. The nanoporous receiver element as defined in claim 1 wherein said substrate comprises a layer of a material having a compressibility of at least about 1% under a pressure of 1 Newton per mm$^2$.

3. The nanoporous receiver element as defined in claim 2 and further including, between said image-receiving layer and said layer of a material having a compressibility of at least about 1% under a pressure of 1 Netwon per mm$^2$, a layer having a thickness of less than about 50 $\mu$m and having a compressibility of less than about 1% under a pressure of 1 Newton per mm$^2$.

4. The nanoporous receiver element as defined in claim 3 wherein said material having a thickness less than about 50 $\mu$m and a compressibility of less than about 1% under a pressure of 1 Newton per mm$^2$ comprises poly(ethylene terephthalate) and said material having a compressibility of at least about 1% under a pressure of 1 Newton per mm$^2$ comprises microvoided polypropylene.

5. The nanoporous receiver element as defined in claim 4 wherein said poly(ethylene terephthalate) layer has a thickness of about 12 μm and said layer of microvoided polypropylene has a thickness of about 150 μm.

6. The nanoporous receiver element as defined in claim 1 wherein said substrate comprises a layer of a material having a thickness of less than about 50 μm and having a compressibility of less than about 1% under a pressure of 1 Newton per $mm^2$.

7. The nanoporous receiver element as defined in claim 1 wherein said image-receiving layer has a pore diameter distribution wherein at least about 50% of the pores having a diameter of greater than about 30 nm have a diameter less than about about 200 nm and at least about 95% of the pores having a diameter greater than about 30 nm have a diameter less than about 500 nm.

8. The nanoporous receiver element as defined in claim 1 wherein said image-receiving layer comprises from about from about 60 to about 90 weight percent of particulate material and from about 10 to about 40 weight percent of binder material.

9. The nanoporous receiver element as defined in claim 1 wherein the outer surface of said image-receiving layer has a surface roughness of less than about 300 nm.

10. The nanoporous receiver element as defined in claim 1 wherein the outer surface of said image-receiving layer has a surface roughness of less than about 200 nm.

11. The nanoporous receiver element as defined in claim 10 wherein said image-receiving layer further includes an epoxysilane compound.

12. The nanoporous receiver element as defined in claim 1 wherein said binder material comprises a hydrophobic material.

13. The nanoporous receiver element as defined in claim 1 and further including a photographic stabilizer material.

14. The nanoporous receiver element as defined in claim 1 wherein said particulate material comprises a silica compound.

15. The nanoporous receiver element as defined in claim 14 wherein said silica compound is selected from the group consisting of silica gel, amorphous silica and fumed silica particles.

16. The nanoporous receiver element as defined in claim 14 wherein said binder material comprises a hydrophobic material.

17. A mass transfer thermal imaging method comprising:

(a) imagewise heating a colored thermal mass transfer donor element; and (b) transferring at least the image areas of said thermal transfer material layer to the receiver layer of a nanoporous receiver element as defined in claim 1.

18. The mass transfer thermal imaging method as defined in claim 17 wherein said donor element comprises a substrate carrying a colored thermal transfer material layer comprising a dye-containing amorphous phase comprising at least one dye, wherein said dye forms a continuous film.

19. The mass transfer thermal imaging method as defined in claim 18 wherein said thermal transfer material layer of said donor element further includes a thermal solvent.

20. The mass transfer thermal imaging method as defined in claim 18 wherein said binder of said image-receiving layer of said receiver element comprises a hydrophobic material.

21. The mass transfer thermal imaging method as defined in claim 20 wherein said image-receiving layer further includes an epoxysilane compound.

22. The mass transfer thermal imaging method as defined in claim 17 wherein said particulate material of said image-receiving layer comprises a silica compound selected from the group consisting of silica gel, amorphous silica and fumed silica particles.

23. The mass transfer thermal imaging method as defined in claim 17 wherein said receiver element further includes a photographic stabilizer material.

24. The mass transfer thermal imaging method as defined in claim 17 wherein a plurality of said donor elements are imagewise heated, each of said donor elements being differently colored, and at least the image areas of each said transfer material are transferred to said receiver element whereby a multicolor image is formed on said receiver element.

25. The mass transfer thermal imaging method as defined in claim 24 wherein cyan, magenta and yellow colored donor elements are imagewise heated and at least the image areas of said cyan, magenta and yellow transfer material are transferred to said receiver element whereby a multicolor image is formed on said receiver element.

* * * * *